US010883497B2

(12) United States Patent
Grimes et al.

(10) Patent No.: US 10,883,497 B2
(45) Date of Patent: Jan. 5, 2021

(54) SYSTEMS AND METHODS OF SECURING A COMPLIANT MEMBER IN A PUMP

(71) Applicant: Micropump, Inc., a Unit of IDEX Corporation, Vancouver, WA (US)

(72) Inventors: David J. Grimes, Beaverton, OR (US); Charles F. Carr, Battle Ground, WA (US)

(73) Assignee: Micropump, Inc., a Unit of IDEX Corporation, Vancouver, WA (US)

( * ) Notice: Subject to any disclaimer, the term of this patent is extended or adjusted under 35 U.S.C. 154(b) by 298 days.

(21) Appl. No.: 15/809,857

(22) Filed: Nov. 10, 2017

(65) Prior Publication Data

US 2018/0135628 A1 May 17, 2018

Related U.S. Application Data

(60) Provisional application No. 62/421,116, filed on Nov. 11, 2016.

(51) Int. Cl.
*F04C 5/00* (2006.01)
*F04C 2/08* (2006.01)
(Continued)

(52) U.S. Cl.
CPC ..... *F04C 5/00* (2013.01); *F04C 2/08* (2013.01); *F04C 2/084* (2013.01); *F04C 2/18* (2013.01);
(Continued)

(58) Field of Classification Search
CPC ..... F04C 15/0049; F04C 2/08; F04C 2/084; F04C 2/18; F04C 5/00; F04C 2240/30
See application file for complete search history.

(56) References Cited

U.S. PATENT DOCUMENTS 3,498,232 A * 3/1970 Moorcroft ..... F04C 2/086 418/126
4,127,365 A * 11/1978 Martin ..... F04C 2/18 417/410.1
(Continued)

FOREIGN PATENT DOCUMENTS

CA 2698213 6/2016
DE 33 42 385 6/1985
(Continued)

OTHER PUBLICATIONS

Declaration Under 37 C.F.R. § 1.132 of Charles F. Carr, dated Apr. 25, 2018.
(Continued)

*Primary Examiner* — Christopher S Bobish
(74) *Attorney, Agent, or Firm* — Klarquist Sparkman, LLP

(57) ABSTRACT

A pump includes a pump-head portion including a pump body and a magnet cup. The pump body defines an inlet and an outlet, and the pump body and the magnet cup together define a pump cavity. The pump includes a suction shoe situated on the pump body. The suction shoe includes an engaging portion. The pump includes a movable pumping member situated in the pump cavity and at least partially received within the suction shoe. The pump includes a permanent magnet coupled to the pumping member. The pump includes a pump-driver portion including a magnet driver located outside the magnet cup. The pump includes a pressure-absorbing member situated in the pump cavity. The pressure-absorbing member is configured to engage the engaging portion of the suction shoe such that the suction shoe is urged radially inwardly with respect to an outer edge portion of the surface of the pump body.

20 Claims, 11 Drawing Sheets

(51) Int. Cl.
*F04C 2/18* (2006.01)
*F04C 15/00* (2006.01)

(52) U.S. Cl.
CPC ..... *F04C 15/0049* (2013.01); *F04C 2240/30* (2013.01)

(56) References Cited

U.S. PATENT DOCUMENTS

| | | | | |
|---|---|---|---|---|
| 4,493,625 | A * | 1/1985 | Pieters | F04C 2/084 418/126 |
| 4,629,562 | A | 12/1986 | Kercher | |
| 4,802,818 | A | 2/1989 | Wiggins et al. | |
| 5,122,039 | A | 6/1992 | Tuckey | |
| 5,141,415 | A | 8/1992 | Budecker et al. | |
| 5,413,468 | A | 5/1995 | Tuckey | |
| 5,516,266 | A | 5/1996 | Talaski | |
| 5,704,767 | A | 1/1998 | Johnson | |
| 5,860,799 | A | 1/1999 | Scheibe et al. | |
| 7,029,250 | B2 | 4/2006 | Kach | |
| 8,323,008 | B2 * | 12/2012 | Grimes | F04B 7/06 417/540 |
| 8,734,139 | B2 * | 5/2014 | Burns | F04B 11/0033 417/540 |
| 10,082,139 | B2 * | 9/2018 | Welte | F04C 14/02 |
| 2004/0191093 | A1 | 9/2004 | Weigl | |
| 2006/0024188 | A1 | 2/2006 | Muscarella et al. | |
| 2007/0065316 | A1 | 3/2007 | Hanke | |
| 2007/0065322 | A1 * | 3/2007 | Paramonoff | F04C 14/18 417/572 |
| 2012/0211093 | A1 * | 8/2012 | Grimes | F04B 17/03 137/334 |
| 2014/0161651 | A1 * | 6/2014 | Grimes | F04B 17/042 417/420 |

FOREIGN PATENT DOCUMENTS

| | | |
|---|---|---|
| EP | 0 496 591 | 7/1992 |
| EP | 0 583 003 | 2/1994 |
| EP | 2 588 759 | 5/2013 |
| FR | 2 499 651 | 8/1982 |
| GB | 1539544 | 1/1979 |
| JP | S60-033355 U1 | 3/1985 |
| JP | H03-111683 | 5/1991 |
| JP | H07-042447 U1 | 8/1995 |
| JP | 2001-182648 | 7/2001 |
| JP | 2002-227791 | 8/2002 |
| JP | 2005-511969 | 4/2005 |
| WO | WO 95/25891 | 9/1995 |
| WO | WO 2006/071735 | 7/2006 |
| WO | WO 2009/029858 | 3/2009 |

OTHER PUBLICATIONS

International Search Report and Written Opinion of the International Searching Authority, dated Jan. 23, 2018, from PCT Application No. PCT/US2017/061177.
Communication Pursuant to Article 94(3) EPC issued in EPC Application No. 17805062.1 dated Mar. 11, 2020, 5 pp.

* cited by examiner

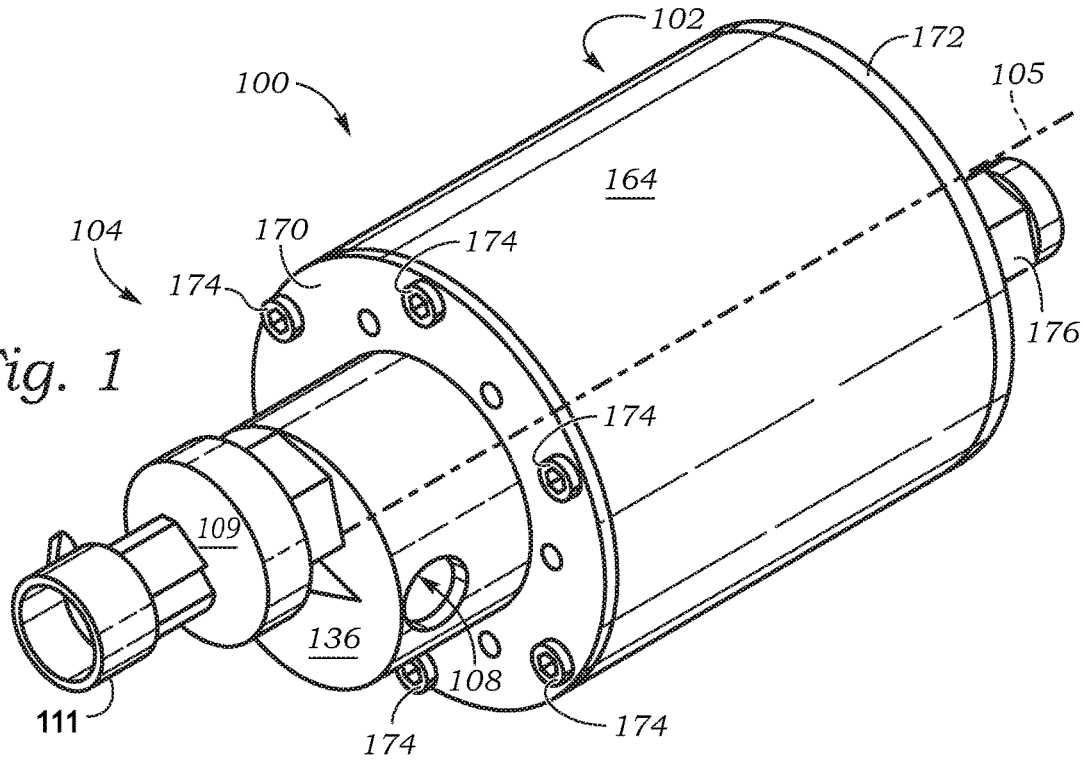
Fig. 1
Fig. 2
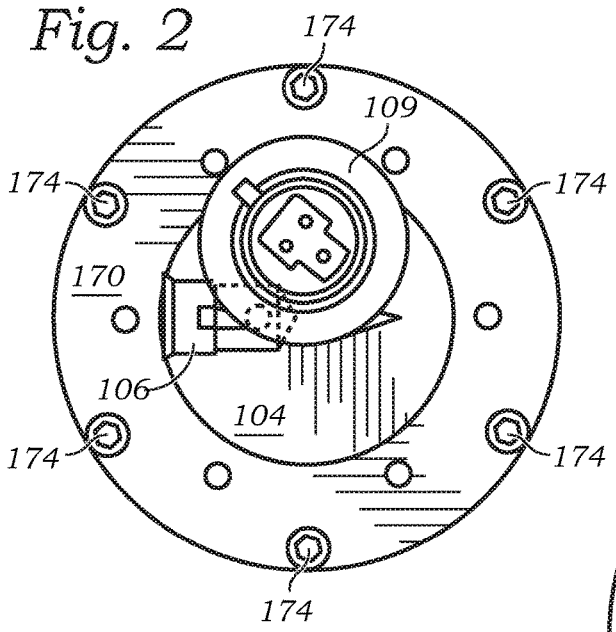
Fig. 3
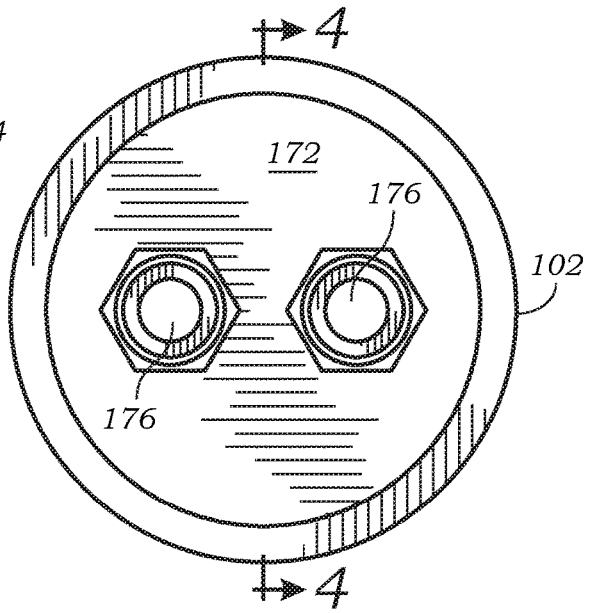

SYSTEMS AND METHODS OF SECURING A COMPLIANT MEMBER IN A PUMP

CROSS REFERENCE TO RELATED APPLICATION

This application claims priority to and the benefit of U.S. Provisional Patent Application No. 62/421,116 filed on Nov. 11, 2016, which is incorporated herein by reference in its entirety.

FIELD

The present disclosure relates to pumps and pump-heads capable of accommodating a volume expansion of the liquid in the pump-head, such as by a freezing event, a pressure fluctuation, or the like.

BACKGROUND

Rotary displacement pumps, such as gear pumps, are especially useful for pumping liquids and other fluids in applications requiring accurate delivery of fluid to a point of use and a high degree of reliability. Certain applications also require that the pumps be capable of operating in a wide temperature range, including at the operating temperature of machinery such as internal combustion engines, and at temperatures below the freezing point of water or other dilute aqueous liquids, such as temperatures experienced in freezing winter climates or at high altitudes. Water and other aqueous liquids undergo a volumetric expansion when changing between the liquid and solid phases. This volumetric expansion can severely damage a pump housing primed with the liquid and other components in contact with the liquid. Thus, it can be advantageous for the pumps to be able to withstand or accommodate the volumetric expansion attendant to the freezing of the aqueous liquid being pumped. Accordingly, improvements to freeze protection for pumps are desirable.

SUMMARY

Certain embodiments of the disclosure are directed to pumps capable of accommodating increased pressure events. In a representative embodiment, a pump comprises a pump-head portion including a pump body and a magnet cup. The pump body defines at least one inlet and at least one outlet, and the pump body and the magnet cup together define a pump cavity that is in contact with the liquid being pumped whenever the pump cavity is primed with the liquid. The pump further comprises a suction shoe situated on the pump body. The suction shoe includes an engaging portion. The pump further comprises a movable pumping member situated in the pump cavity and at least partially received within the suction shoe, the pumping member, when driven to move, urging flow of the liquid from the inlet through the pump cavity and the magnet cup to the outlet. The pump further comprises a permanent magnet situated in the magnet cup. The magnet is rotatable in the magnet cup and is coupled to the movable pumping member in the pump cavity. The pump further comprises a pump-driver portion including a magnet driver located outside the magnet cup. The magnet driver is magnetically coupled through the magnet cup to the magnet to rotate the magnet in the magnet cup and, thus, move the pumping member in the pump cavity. The pump further comprises a pressure-absorbing member situated in the pump cavity. The pressure-absorbing member is configured to engage the engaging portion of the suction shoe such that the suction shoe is urged radially inwardly with respect to an outer edge portion of the surface of the pump body.

In another representative embodiment, a gear pump-head comprises a pump body and a magnet cup together defining a pump cavity, at least one inlet in fluid communication with the pump cavity, and at least one outlet in fluid communication with the pump cavity. The gear pump-head further comprises at least one driving gear and a driven gear enmeshed with each other in the pump cavity, and a suction shoe situated about the driving gear and the driven gear on the pump body. The suction shoe includes an engaging portion. The gear pump-head further comprises a permanent magnet situated in the magnet cup and being coupled to the driving gear, and a pressure-absorbing member situated in the pump cavity. The pressure-absorbing member is configured to engage the engaging portion of the suction shoe such that the suction shoe is urged radially inwardly with respect to an outer edge portion of the surface of the pump body.

In another representative embodiment, a gear pump-head comprises a pump body and a magnet cup together defining a pump cavity, at least one inlet in fluid communication with the pump cavity, and at least one outlet in fluid communication with the pump cavity. The gear pump-head further comprises at least one driving gear and a driven gear enmeshed with each other in the pump cavity, and a suction shoe situated about the driving gear and the driven gear on the pump body. The suction shoe includes an engaging portion. The gear pump-head further comprises a permanent magnet situated in the magnet cup and coupled to the driving gear, and a pressure-absorbing member situated in the pump cavity. At least a portion of the pressure-absorbing member extends along a longitudinal axis of the pump between a surface of the pump body and an interior surface of the magnet cup when the pressure-absorbing member is in a non-deflected state. The interior surface of the magnet cup is configured to contact an upper surface of the pressure-absorbing member such that the pressure-absorbing member is captured between the surface of the pump body and the interior surface of the magnet cup to limit axial movement of the pressure-absorbing member in the pump cavity. The pressure-absorbing member is configured to engage the engaging portion of the suction shoe such that the suction shoe is urged radially inwardly with respect to an outer edge portion of the surface of the pump body.

In another representative embodiment, a pump comprises a pump-head portion including a pump body and a magnet cup. The pump body defines at least one inlet and at least one outlet, and the pump body and the magnet cup together define a pump cavity that is in contact with the liquid being pumped whenever the pump cavity is substantially primed with the liquid. The pump further comprises a movable pumping member situated in the pump cavity. The pumping member, when driven to move, urges flow of the liquid from the inlet through the pump cavity and the magnet cup to the outlet. The pump further comprises a permanent magnet situated in the magnet cup that is rotatable in the magnet cup and coupled to the movable pumping member in the pump cavity. The pump further comprises a pump-driver portion including a magnet driver located outside the magnet cup. The magnet driver is magnetically coupled through the magnet cup to the magnet to rotate the magnet in the magnet cup and, thus, move the pumping member in the pump cavity. The pump further comprises a pressure-absorbing member situated in the pump cavity. At least a portion of the pressure-absorbing member extends between the pump body and the magnet cup when the pressure-absorbing member is in a non-deflected state such that the pressure-absorbing member is captured between the pump body and the magnet cup to limit axial movement of the pressure-absorbing member.

In another representative embodiment, a gear pump-head comprises a pump body and a magnet cup together defining a gear cavity. The gear pump-head further comprises at least one inlet in fluid communication with the gear cavity, and at least one outlet in fluid communication with the gear cavity. The magnet cup is in fluid communication with the gear cavity. The gear pump-head further comprises at least one driving gear and a driven gear enmeshed with each other in the gear cavity, and a permanent magnet situated in the magnet cup and being coupled to the driving gear in the gear cavity. The gear pump-head further comprises a magnet driver located outside the magnet cup and being magnetically coupled through the magnet cup to the magnet to rotate the magnet in the magnet cup and thus rotate the gears in the gear cavity. The gear pump-head further comprises a pressure-absorbing member situated in the gear cavity. The pressure-absorbing member includes a main body portion extending between the pump body and the magnet cup when the pressure-absorbing member is in a non-deflected state such that the pressure-absorbing member is captured between the pump body and the magnet cup to limit axial movement of the pressure-absorbing member in the gear cavity.

In another representative embodiment, a hydraulic circuit comprises a pump, a source of aqueous liquid upstream of and in fluid communication with the pump, and an injector downstream of and in fluid communication with the pump. The pump further comprises a pump-head portion including a pump body and a magnet cup. The pump body defines at least one inlet and at least one outlet. The pump body and the magnet cup together define a pump cavity that is in contact with the liquid being pumped whenever the pump cavity is substantially primed with the liquid. The pump further comprises a movable pumping member situated in the pump cavity. The pumping member, when driven to move, urges flow of the liquid from the inlet through the pump cavity and the magnet cup to the outlet. The pump further comprises a permanent magnet situated in the magnet cup, the magnet being rotatable in the magnet cup and being coupled to the movable pumping member in the pump cavity. The pump further comprises a pump-driver portion including a magnet driver located outside the magnet cup. The magnet driver is magnetically coupled through the magnet cup to the magnet to rotate the magnet in the magnet cup and, thus, move the pumping member in the pump cavity. The pump further comprises a pressure-absorbing member situated in the pump cavity. The pressure-absorbing member includes a main body portion extending between the pump body and the magnet cup when the pressure-absorbing member is in a non-deflected state such that the pressure-absorbing member is captured between the pump body and the magnet cup to limit axial movement of the pressure-absorbing member.

The foregoing and other objects, features, and advantages of the disclosed technology will become more apparent from the following detailed description, which proceeds with reference to the accompanying figures.

BRIEF DESCRIPTION OF THE DRAWINGS

FIG. 1 is a perspective view of a representative embodiment of a magnetically-driven gear pump.

FIG. 2 is an end elevation view of the gear pump of FIG. 1, in which the pump-head portion is visible.

FIG. 3 is an end elevation view of the gear pump of FIG. 1, in which the end plate and electrical connections of the pump-driver portion are visible.

DETAILED DESCRIPTION

Figure 4:
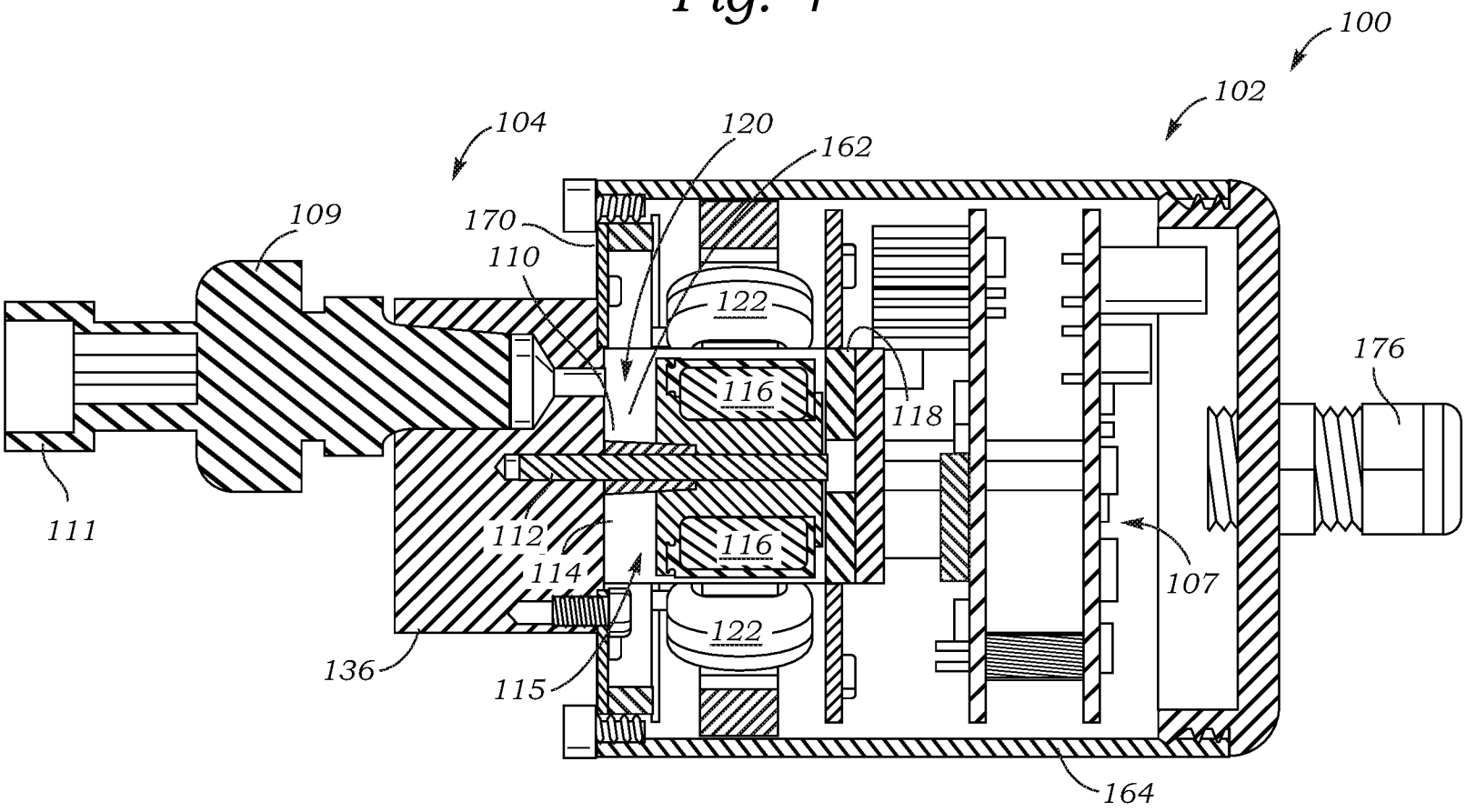
FIG. 4 is a cross-sectional view of the gear pump of FIG. 1 taken along line 4-4 of FIG. 3.

FIGS. 1-4 illustrate a representative embodiment of a pump 100 configured as a magnetically-driven gear pump. The pump 100 includes a pump-driver portion 102 and a pump-head portion 104, which are symmetric about an axis 105. The pump-driver portion 102 comprises an outer casing or housing 164, a first end plate 170, and a second end plate 172. The end plates 170, 172 can be attached to the housing 164 by bolts 174. As shown in FIG. 3, the second end plate 172 includes a pair of threaded electrical connectors 176.

The pump-head portion 104 includes a pump body 136 (also referred to has a "fitting block"), which is symmetrical about the axis 105, and which defines an inlet 106 and an outlet 108. The pump-head portion 104 also includes a pumping element configured as a pump gear 110 mounted on a shaft 112 (see FIGS. 4 and 5A). The pump gear 110 can be a driving gear, and can engage or mesh with a driven pump gear 114 such that rotation of the driving gear 110 causes corresponding contra-rotation of the driven pump gear 114 to produce liquid flow. The pump gears 110, 114 can be situated in a gear cavity 115 (a portion of the "pump cavity" described below that also includes the interior surfaces of the inlet and outlet ports).

Figure 5A:
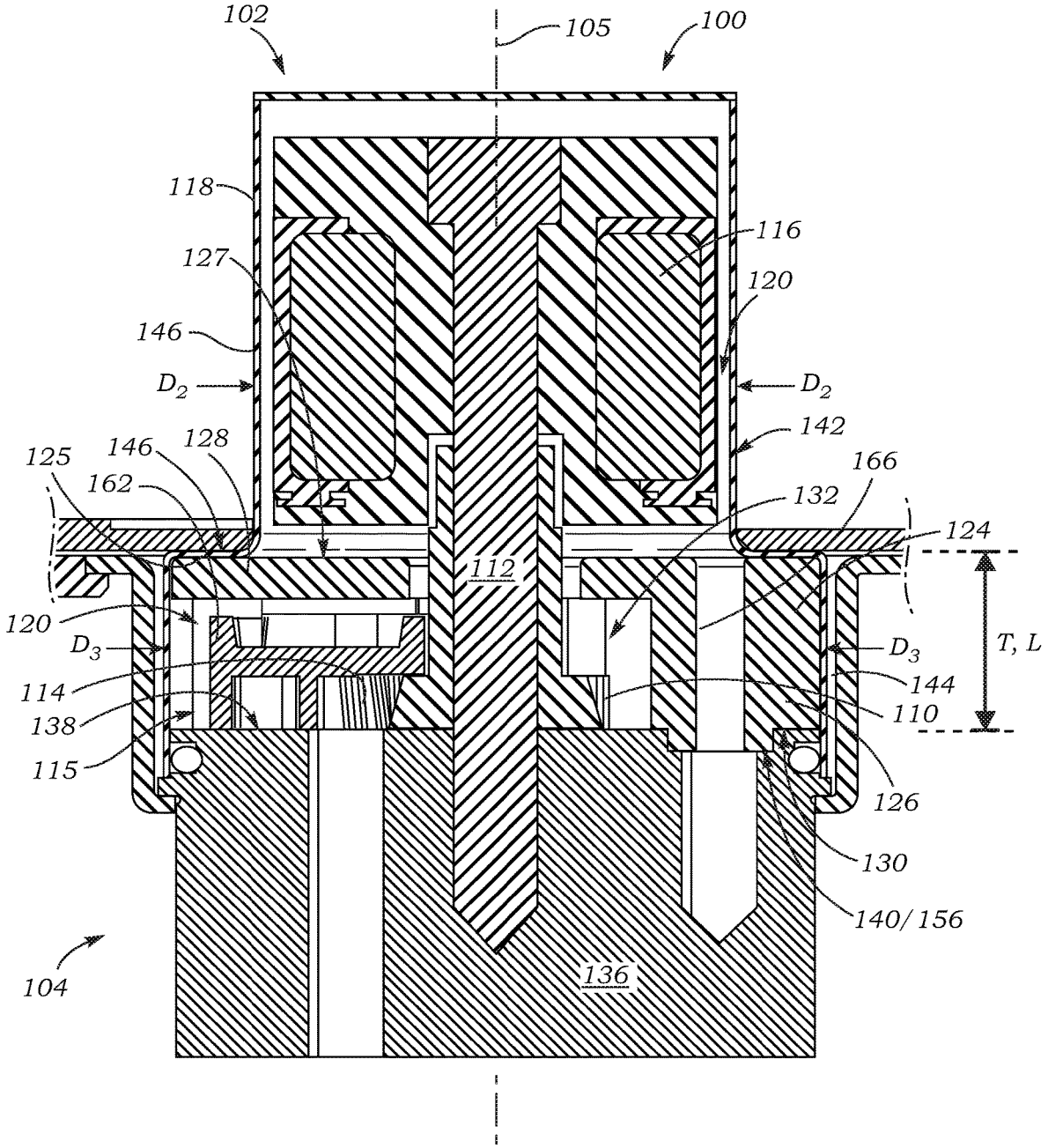
FIG. 5A is a sectional view in elevation of another embodiment of the gear pump of FIG. 1 including a pressure-absorbing member disposed in the pump cavity.

In the illustrated configuration, the pump is configured as a suction shoe-style pump, and the pump gears 110, 114 can be situated to run on a surface 138 of the pump body 136, as best shown in FIG. 5A. A permanent magnet 116 is coupled to the shaft 112, and the magnet 116 can be situated in a magnet cup 118. The magnet cup 118 extends into the pump-driver portion 102. The pump body 136 can be coupled to the end plate 170 and sealed against the rim of the magnet cup 118 such that the pump body 136, the gear cavity 115, and the magnet cup 118 of the pump-head portion 104 together define a pump cavity 120 that is bathed by the liquid being pumped. In other words, the pump cavity 120 is defined by the fluid-wetted interiors of the components of the pump-head portion 104. The magnet cup 118 separates the driven magnet 116 from electrical parts of the assembly in the pump-driver portion 102 that are kept dry (i.e., not wetted by the liquid being pumped). A suction shoe 162 is situated about the pump gears 110, 114 in the gear cavity on the surface 138 of the pump body 136, and seals the inflow side of the gears from the outflow side of the gears.

The pump body 136 defines passageways leading to and from the pump cavity 120 and connecting the pump cavity to the inlet and outlet ports 106, 108. In certain embodiments, the pump body 136 also includes a pressure transducer 109 (that can be in fluid communication with the outlet port 108, for example). The pressure transducer 109 includes an electrical connector 111, permitting electrical connection of the pressure transducer in a manner that establishes, for example, feedback control of the electrical components of the pump-driver portion 102 further described below.

Coaxially surrounding the magnet cup 118 is a stator 122 that is a respective component of the pump-driver portion 102. The stator 122 is located outside the pump cavity 120 and is magnetically coupled to the magnet 116 across the walls of the magnet cup 118 such that a changing magnetic field of the stator 122 induces rotation of the magnet 116 and the shaft 112 and, hence, of the pump gears 110, 114, to produce a flow of liquid. The stator 122 comprises wire windings that are selectively energized by electronics 107 disposed in the housing 164 via the electrical connectors 176. In the illustrated embodiment, the magnet cup 118, the stator 122, and the associated electrical components 107 of the pump-driver portion 102 are disposed in the housing 164, which can be coupled to the pump body 136 to form the pump 100.

FIG. 5A illustrates a configuration of the pump 100 including a pressure-absorbing member 124 disposed in the pump cavity 120 and, more particularly, in the gear cavity 115. The pressure-absorbing member 124 can be a compliant member that is configured to compress or contract in response to an increase in pressure in the liquid inside the pump cavity. In certain embodiments, the pressure increase can be static, such as accompanying freezing of the liquid inside the pump cavity, or dynamic, such as pressure fluctuations in the liquid as it is being pumped (also referred to as "pressure pulses"). Upon relief of the increased pressure condition, the pressure-absorbing member 124 can be configured to expand or otherwise return to its original non-deformed state.

For absorbing pressure accompanying freeze-expansion of the liquid in the pump cavity, the pressure-absorbing member 124 can have sufficient compressible volume such that, if the liquid inside the primed cavity freezes and expands, the resulting increase in pressure inside the cavity causes the pressure-absorbing member to contract sufficiently to "absorb" the expansion and, thus, to relieve or prevent a buildup of pressure inside the pump that would otherwise damage the pump.

By way of example, water and dilute aqueous solutions exhibit a maximum expansion of about 11% by volume upon undergoing the phase transition from liquid to solid. By contracting in response to this volume increase, the pressure-absorbing member can prevent freeze damage to the pump, such as fracture of the magnet cup, damage to the magnet, damage of any sensors in contact with the liquid (e.g., pressure transducers), and/or damage to other parts of the pump.

Figure 6:
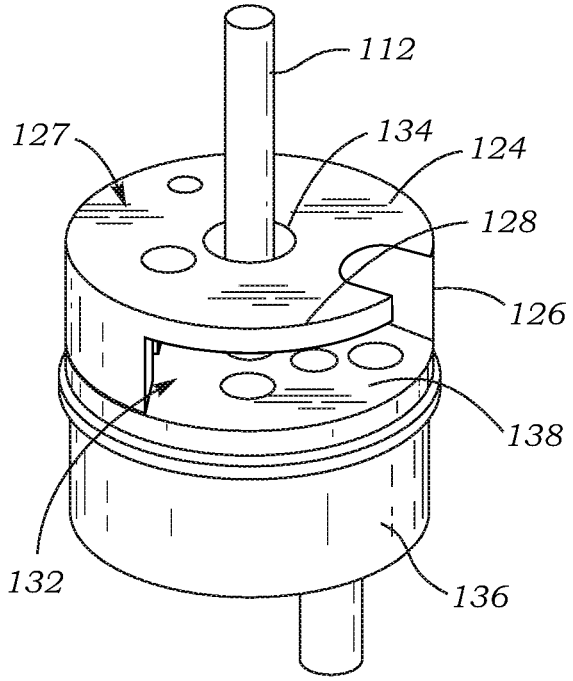
FIG. 6 is a perspective view of the pressure-absorbing member of FIG. 5A situated on a pump body.
Figure 7:
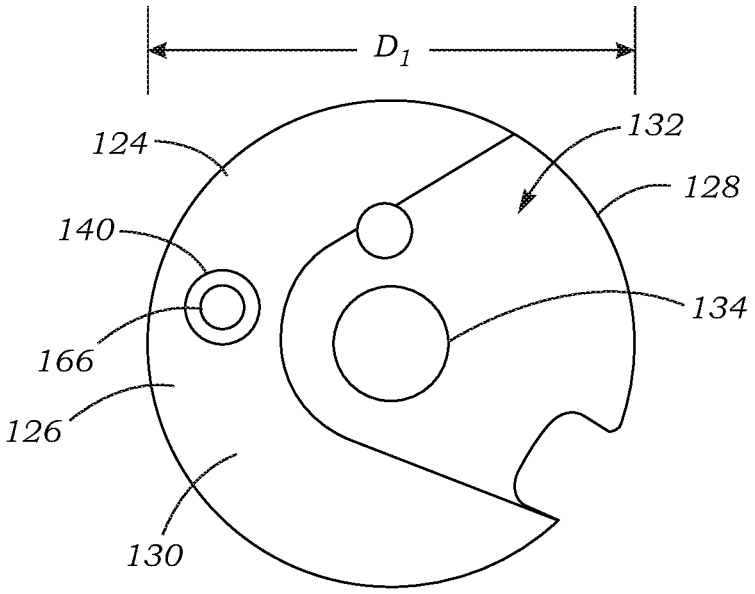
FIG. 7 is a bottom plan view of the pressure-absorbing member of FIG. 5A.

FIGS. 6-7 illustrate the pressure-absorbing member 124 in greater detail. In the illustrated configuration, the pressure-absorbing member 124 can include a main body portion 126 having an extension portion 128. The main body 126 of the pressure-absorbing member 124 can have a generally cylindrical profile, and can have a diameter $D_1$ (FIG. 7). A thickness dimension T (FIG. 5A) of the main body portion 126 can be equal to an overall height dimension of the pressure-absorbing member, and can correspond to a distance L between the surface 138 of the pump body 136 and the magnet cup 118 when the pressure-absorbing member is in a non-deflected state.

The main body portion 126 can define a recess 132. In the illustrated configuration, the recess 132 is curved such that the main body portion 126 has a generally C-shaped profile, as best shown in FIG. 7. The extension portion 128 can extend over the recess 132 to at least partially enclose the recess. The pressure-absorbing member 124 can define a central opening 134 to receive the shaft 112. In the illustrated configuration, the central opening 134 is defined in the extension portion 128, although other configurations are possible. The pressure-absorbing member can also have a retaining feature configured as a tubular extension portion 140. The tubular extension portion 140 can extend from a surface 130 of the main body portion 126 that is intended to contact the pump body 136 when the pressure-absorbing member is disposed in the pump. In the illustrated configuration, the extension portion 140 can surround an opening of a passage 166 defined in the main body portion 126. In certain embodiments, the passage 166 can be configured as a flow passage, or to receive, for example, a support shaft, a fastener, etc. In particular embodiments, the pressure-absorbing member 124 can include any suitable number of extension portions at any suitable location along the surface 130 of the pressure-absorbing member. The pressure-absorbing member 124 can also define various other openings and/or recesses to accommodate, for example shafts, pins, and/or other features of the pump assembly, as desired.

Referring again to FIG. 5A, the pressure-absorbing member 124 can be situated in the pump cavity 120 such that the surface 130 of the main body portion 126 contacts the surface 138 of the pump body 136. In the illustrated configuration, the magnet cup 118 can have a first portion 142 (the upper portion in FIG. 5A) having a diameter $D_2$, and a "flared" second portion 144 having a diameter $D_3$ that is greater than the diameter $D_2$. Due to the stepped difference between the diameters $D_2$ and $D_3$, the magnet cup 118 can define an annular intermediate portion 146 (also referred to as an "annular shoulder") having a surface that is angled relative to a longitudinal axis 105 of the pump. For example, in the illustrated embodiment, the annular shoulder 146 is perpendicular to the longitudinal axis 105 of the pump, although the annular shoulder 146 may form any suitable angle with the axis 105, such as 45 degrees, 60 degrees, 70 degrees, 80 degrees, etc.

Thus, the magnet 116 can be located in the first portion 142 of the magnet cup 116, while the second portion 144 can be configured to receive the pressure-absorbing member 124. For example, in the illustrated embodiment, an interior surface 125 of the intermediate portion 146 of the magnet cup contacts an upper surface 127 of the pressure-absorbing member. The extension portion 140 of the main body portion 126 of the pressure-absorbing member 124 can also be received in a corresponding recess 156 defined in the surface 138 of the pump body 136. In this manner, the pressure-absorbing member 124 can be captured between the intermediate portion 146 of the magnet cup and the surface 138 of the pump body 136. The pressure-absorbing member can also be prevented from being displaced perpendicular to the longitudinal axis 105 of the pump by the extension portion 140. The extension portion 140 and/or the shaft 112 can also prevent rotation of the pressure-absorbing member 124 within the cavity.

In the illustrated configuration, the pressure-absorbing member 124 can also accommodate the pump gears 110, 114, and the suction shoe 162 in the recess 132. In this manner, the pressure-absorbing member 124 can prevent unwanted movement of the suction shoe 162 and, hence, of the pump gears 110, 114, within the pump cavity. The pressure-absorbing member 124 and the suction shoe 162 can also engage each other in a variety of ways. For example, in certain configurations, the pressure-absorbing member 124 and the suction shoe 162 can be configured to engage one another such that the pressure-absorbing member holds the suction shoe in place on the pump body 136.

Figure 5B:
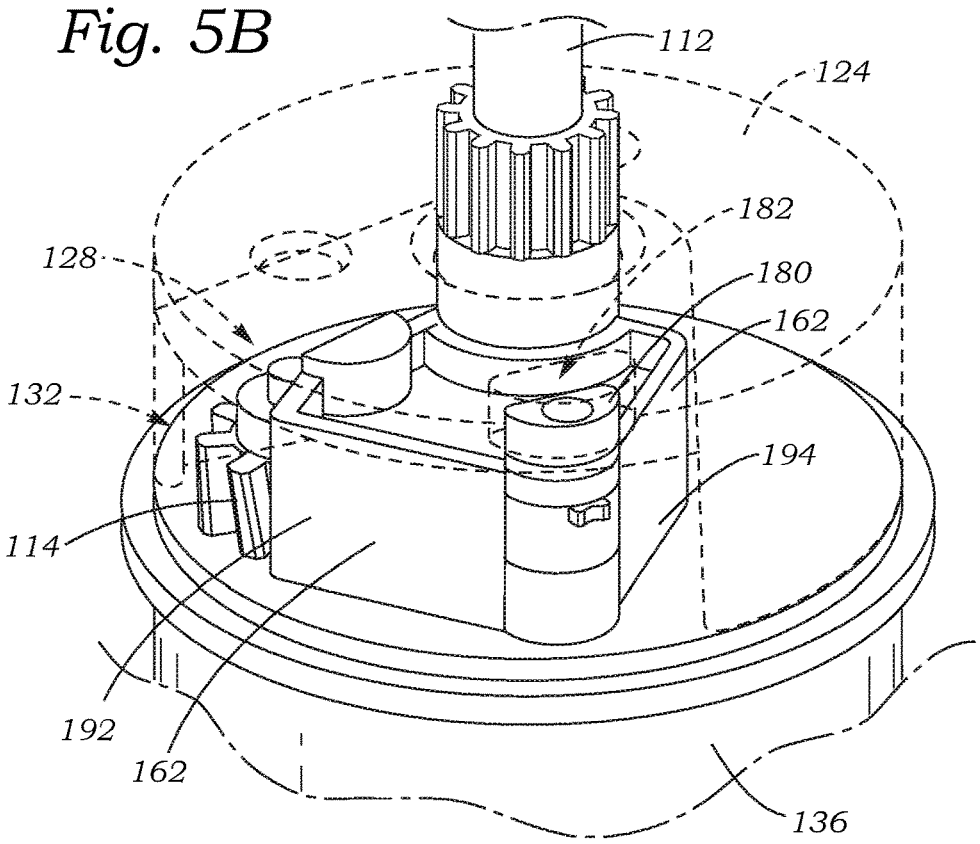
FIG. 5B is a perspective view of the pump body of the gear pump of FIG. 5A illustrating a projection of a suction shoe received in a recess of the pressure-absorbing member.

For example, FIG. 5B illustrates another embodiment of the pump 100 in which the magnet cup 118 is removed and the pressure-absorbing member 124 is shown in phantom for purposes of illustration. In the embodiment of FIG. 5B, the suction shoe 162 is configured as an L-shaped member including a first portion or lobe 192 and a second portion or lobe 194, and is shown received in the recess 132 of the pressure-absorbing member 124. The suction shoe 162 can also include an engaging portion configured as a protrusion or extension portion 180. In the illustrated embodiment, the extension portion 180 is located on the radially outward aspect at or near the apex of the L-shaped suction shoe 162 between the lobes 192 and 194, although other configurations are possible.

The extension portion 180 can engage a corresponding engaging portion of the pressure-absorbing member 124. For example, in the illustrated embodiment, the extension portion 180 can extend into an engaging portion of the pressure-absorbing member 124 configured as a pocket or recess 182 defined in the pressure-absorbing member 124. In the illustrated embodiment, the recess 182 is located in the extension portion 128 of the pressure-absorbing member, although the recess can be located at any suitable location depending upon the particular configuration.

The walls of the recess 182 can contact the extension portion 180 such that the pressure-absorbing member 124 urges or biases the suction shoe 162 toward the shaft 112, and centers the suction shoe about the gears 110, 114. In certain configurations, the recess 182 can be larger than the extension portion 180 such that the suction shoe can move or "float" relative to the pump body 136 and/or relative to the pressure-absorbing member 124 within a predetermined range of motion defined by the boundaries established by the walls of the recess 182. In certain configurations, the recess 182 can be configured such that the pressure-absorbing member 124 presses downwardly on the extension portion 180 to bias the suction shoe 162 downwardly and hold the suction shoe in place on the pump body 136. In other configurations, a spring or other biasing member can apply downward force to hold the suction shoe 162 in place, as desired.

Figure 5C:
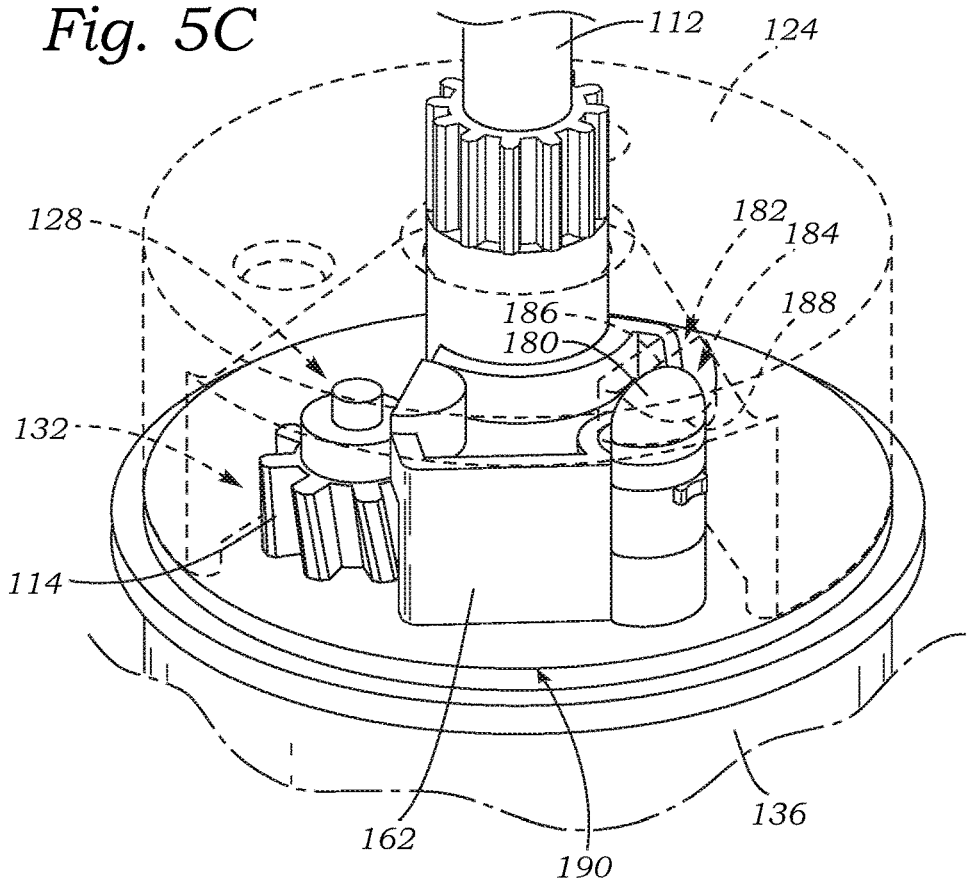
FIG. 5C is a perspective view of another embodiment of the gear pump of FIG. 5A illustrating a rounded projection of the suction shoe received in a recess of the pressure-absorbing member.

FIG. 5C illustrates another embodiment of the pump 100 of FIG. 5A in which the extension portion 180 has a rounded shape, and the recess 182 has an angled interior or upper surface 184. The upper surface 184 can be located on a radially outward aspect of the recess 182, and can be angled such that a radially inward edge 186 of the surface 184 is higher (e.g., farther away from the surface 138 of the pump body 136) than a radially outward edge 188. In other words, the surface 184 is angled inwardly toward the shaft 112 or toward the axis 105 (FIG. 5A). In this manner, the surface 184 can engage the rounded extension portion 180 and bias the extension portion downwardly to hold the suction shoe in place on the pump body 136. The surface 184 can also bias the extension portion 180 radially inwardly toward the shaft 112 with respect to an outer edge portion 190 of the pump body 136. As in the embodiment of FIG. 5B, the recess 182 can be larger than the extension portion 180 such that the suction shoe 162 can "float" or move with respect to the pump body 136 and/or with respect to the pressure-absorbing member 124 within a predetermined range of motion defined by the boundaries or walls of the recess 182. Additional configurations are possible, including embodiments in which the pressure-absorbing member 124 includes an extension portion that is received in a corresponding recess of the suction shoe. Exemplary additional configurations are described below with reference to the pumps of FIGS. 11A, 11B, 12A, and 12B, and it should be understood that any configuration of pressure-absorbing member and suction shoe engagement described herein can be incorporated into any of the disclosed pump configurations.

Figure 5D:
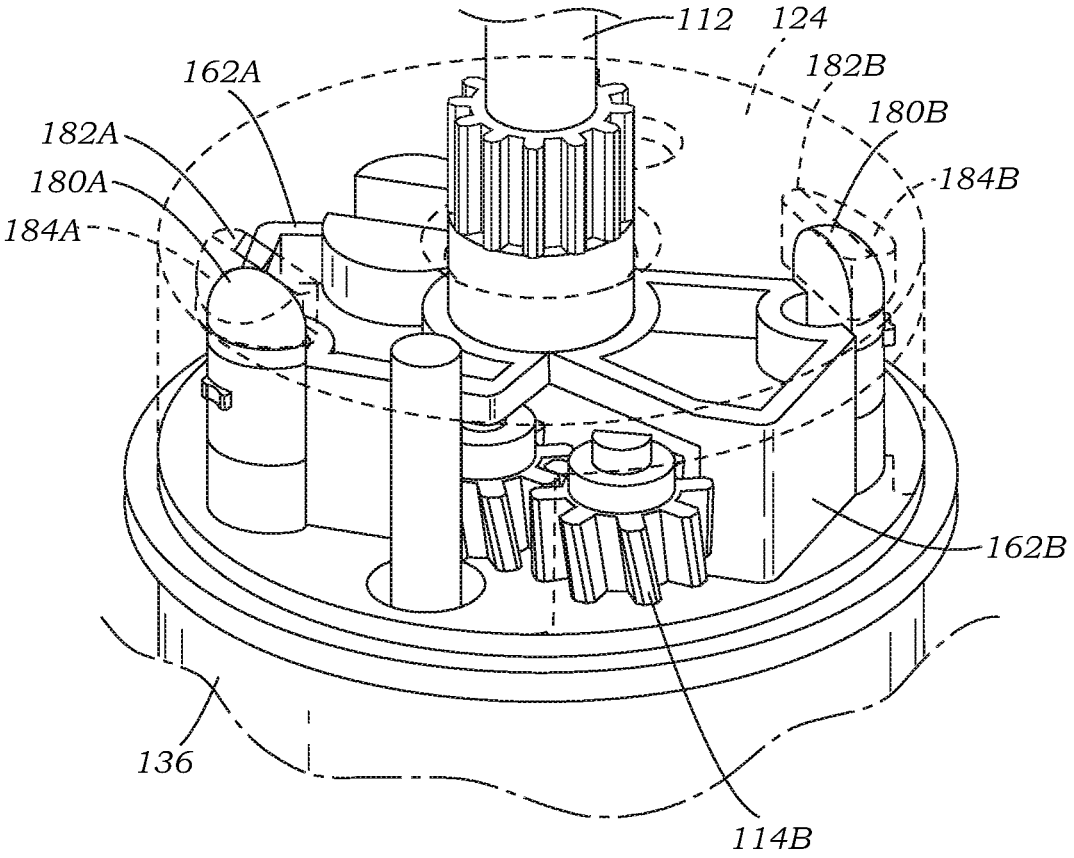
FIG. 5D is a perspective view of another embodiment of the gear pump of FIG. 5C including two suction shoes.

FIG. 5D illustrates another embodiment of the pump 100 of FIG. 5A including two suction shoes configured similarly to the suction shoe in the pump of FIG. 5C. More particularly, the pump of FIG. 5D includes two suction shoes 162A and 162B situated on the pump body 136. Each of the suction shoes 162A, 162B can be situated about one or more pump gears. In the illustrated embodiment, the driven gear 114B associated with the suction shoe 162B can be seen in the foreground of FIG. 5D. The suction shoes 162A, 162B can include respective rounded extension portions 180A and 180B, and the pressure-absorbing member 124 can include corresponding recesses 182A, 182B configured to receive the extension portions 180A, 180B. The recesses 182A, 182B can include respective angled interior surfaces 184A, 184B configured to hold the suction shoes 162A, 162B in place on the pump body 136, and to urge the suction shoes radially inwardly in a direction toward the shaft 112. In other embodiments, the angled surfaces 184A and 184B of the recesses 182A, 182B can be part of a larger interior angled rim portion of the pressure-absorbing member that extends at least partially around the circumference of the pressure-absorbing member.

Figure 8:
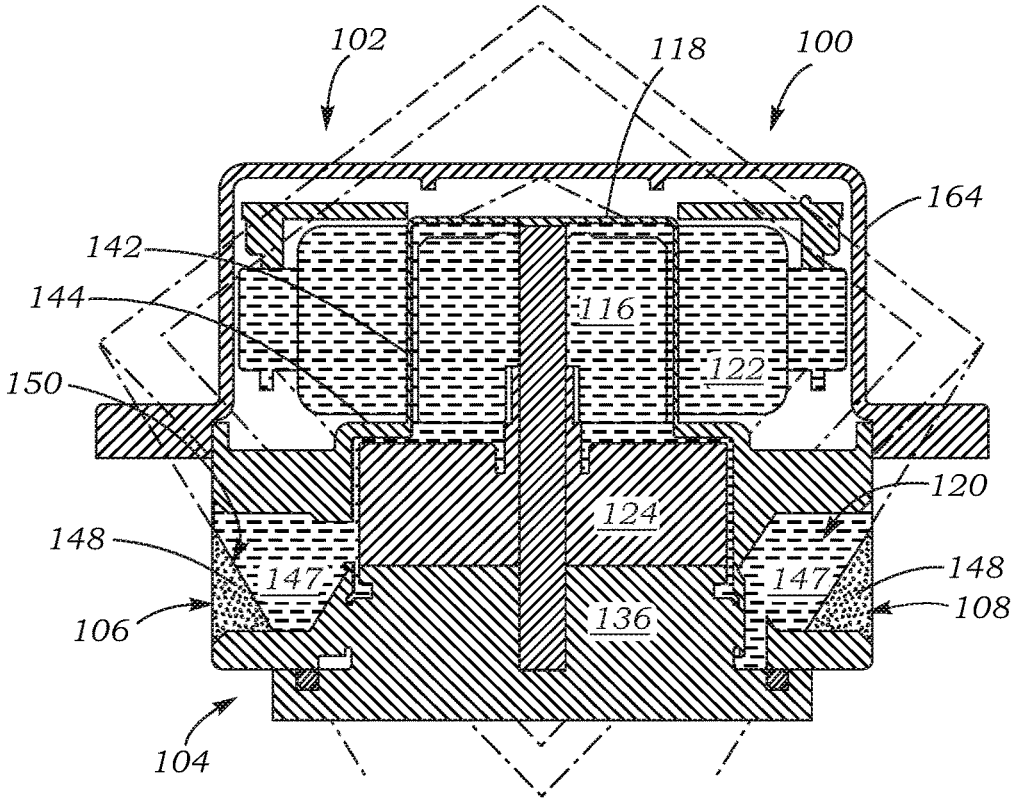
FIGS. 8-10 are cross-sectional views illustrating the process of ice formation in a pump.
Figure 9:
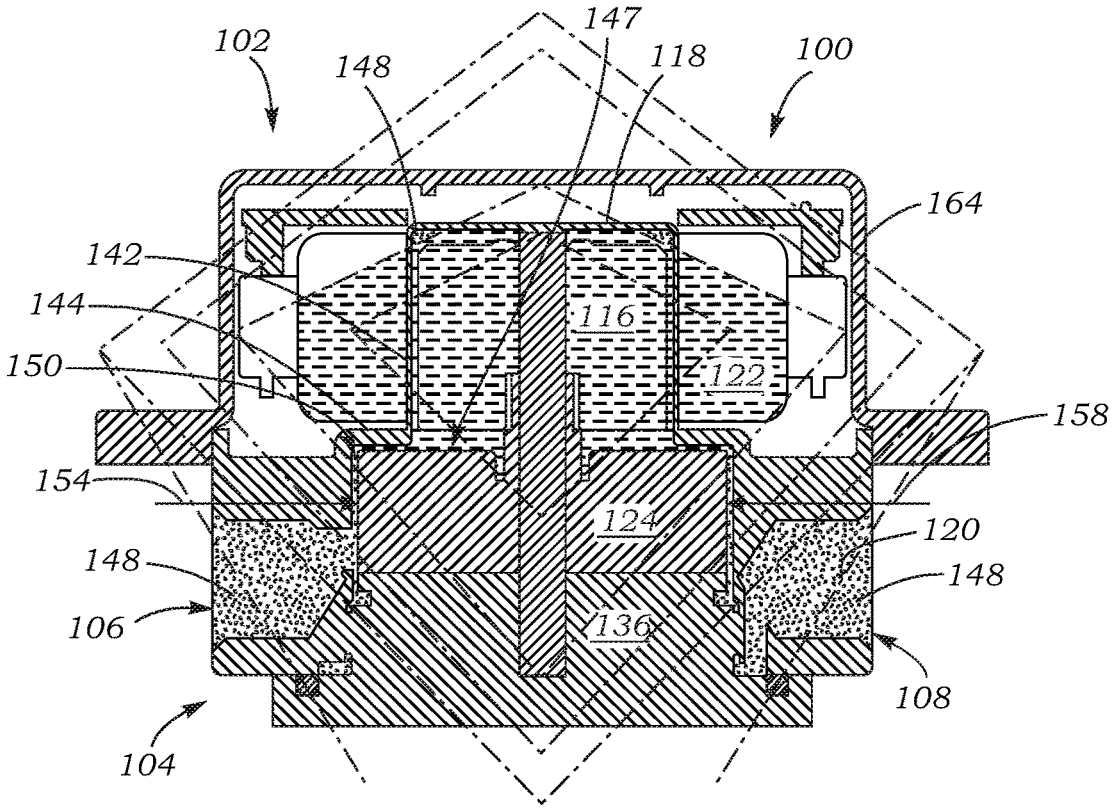
Figure 10:
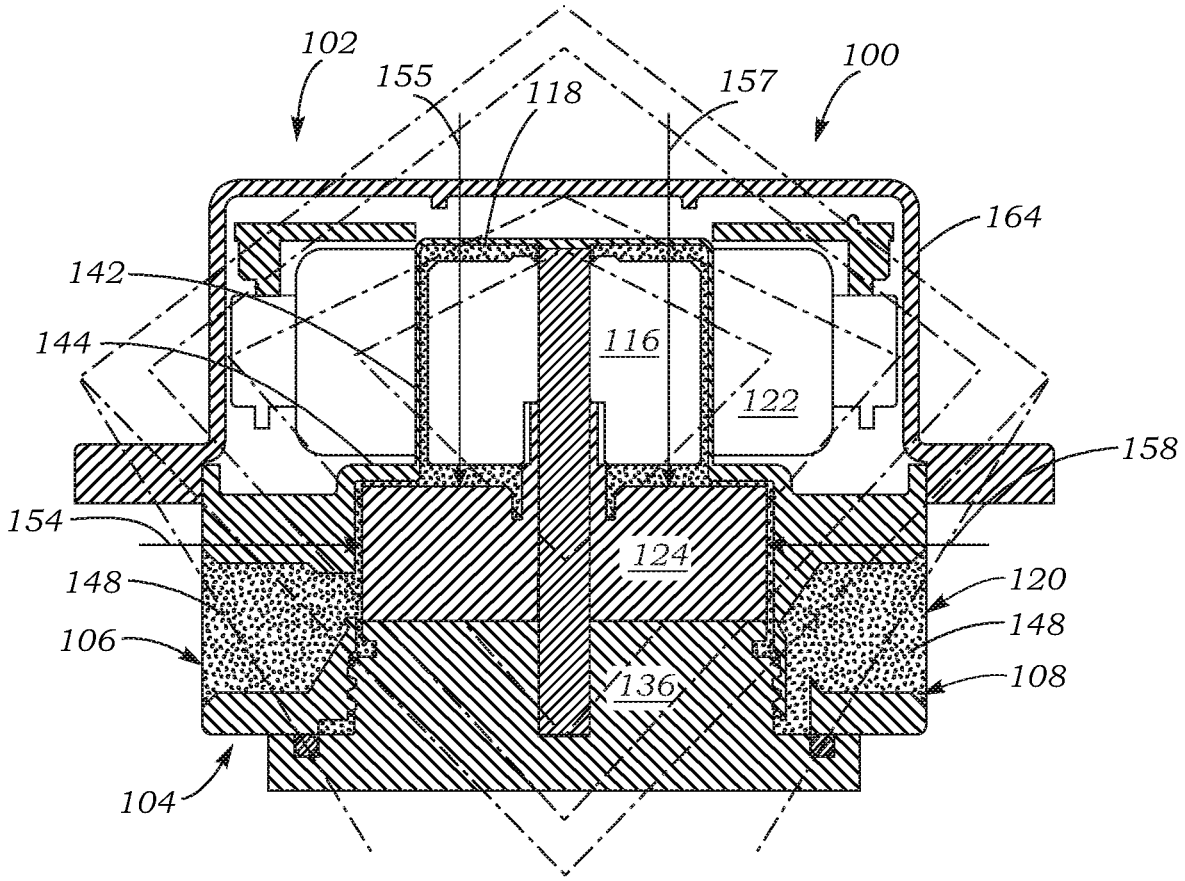

As stated above, the pressure-absorbing member 124 can deform to accommodate freeze-expansion of liquid in the pump cavity. FIGS. 8-10 illustrate the progression of ice formation in the pump 100, such as when an engine or automobile including the pump is turned off in a sub-freezing temperature environment. In FIGS. 8-10, the suction shoe, pump gears, and the recessed portion of the pressure-absorbing member are omitted and the pressure-absorbing member 124 is shown schematically as a monolithic member for purposes of illustration. Horizontal dashed lines in FIGS. 8-10 represent portions of the pump (including components and liquid in the pump cavity) that are at the operating temperature of the pump, while stippled regions represent ice.

Generally, when a liquid 147 in the pump cavity 120 begins to freeze, ice first forms in the regions of the pump cavity closest to the exterior of the pump housing and/or nearest portions of the pump that are exposed to the low-temperature environment (e.g., portions of a pump exposed to ambient air in a winter climate). Referring to FIG. 8, ice 148 can begin to form near the inlet 106 and the outlet 108, and an "ice front" 150 (e.g., the interface between ice 148 and liquid 147) can advance generally inwardly from the exterior of the pump cavity toward the warmer interior. As the pump continues to cool, ice 148 can also begin to form around the interior surfaces of the magnet cup 118, as shown in FIG. 9. A state in which the liquid in the pump cavity is completely frozen is illustrated in FIG. 10.

The ice 148 advancing from the inlet 106 and the outlet 108 can apply pressure to the pressure-absorbing member 124 radially inwardly with respect to the pump housing in the direction of arrows 154 and 158, as shown in FIG. 9. Meanwhile the ice 148 in the magnet cup 118 can apply pressure to the pressure-absorbing member 124 axially along the longitudinal axis of the pump in the direction of arrows 155 and 157, as shown in FIG. 10. This can cause the pressure-absorbing member 124 to deform or compress radially inwardly, as well as axially along the longitudinal axis of the pump, to accommodate the volume expansion attendant to the freezing of the liquid in the pump cavity. The flared lower portion 144 of the magnet cup 118, together with the surface 138 of the pump body 136, can prevent the pressure-absorbing member 124 from moving along the longitudinal axis of the pump in response to pressure exerted by the ice 148. In other words, the lower portion 144 of the magnet cup 118 and the pump body 136 can allow the pressure-absorbing member 124 to deform along its longitudinal axis, while preventing the pressure-absorbing member from traveling or being dislodged from its location in the pump cavity 120.

Meanwhile, the pressure-absorbing member 124 can also deform radially in response to the pressure applied by the ice surrounding the pressure absorbing member such that the pressure-absorbing member assumes a compressed diameter that is smaller than the non-compressed diameter $D_1$. The extension portion 140 located in the recess 156 (see FIG. 5A) can prevent the pressure-absorbing member 124 from moving perpendicular to the longitudinal axis 105 of the pump in the pump cavity. In other words, the extension portion 140 can prevent the pressure-absorbing member from being dislodged in a direction perpendicular to the longitudinal axis 105 of the pump as the pressure-absorbing member radially contracts.

When the ice 148 melts, the pressure-absorbing member 124 can return to its non-deformed state. Moreover, because the pressure-absorbing member 124 is captured between the flared lower portion 144 of the magnet cup 118 and the surface 138 of the pump body 136, which do not move during a freezing event, the pressure-absorbing member can return to substantially the same location in the pump cavity 120 as before the freeze event. In this manner, the pressure-absorbing member 124 can expand and contract through multiple freeze-thaw cycles and return to its initial size and position within the pump cavity upon thawing of the liquid. This can avoid the condition in which the pressure-absorbing member experiences "pre-compression" by, for example, a retaining member or other component of the pump assembly that becomes dislodged by the ice, compresses the pressure-absorbing member, and fails to return to its initial location upon thawing of the liquid. Thus, the embodiments described herein allow the full compressible volume of the pressure-absorbing member 124 to be available to accommodate freeze-expansion of the liquid being pumped through multiple sequential freezing events.

The pressure-absorbing member 124 can be made from any suitable compliant material, such as elastically compressible hydrophobic materials. As used herein, the term "hydrophobic material" refers to a material wherein a liquid droplet on a surface of the material forms a contact angle of greater than 90 degrees. In certain embodiments, the pressure-absorbing member can be made from any of various rubber compounds, such as silicone rubber, etc. The pressure-absorbing member can also be made from any of various closed-cell foam materials, such as fluorinated silicone closed-cell foam. In certain embodiments, the pressure-absorbing member 124 can be non-porous to prevent the ingress of liquid into the body of the pressure-absorbing member, or can be porous, depending upon the particular requirements of the application.

In some embodiments, the compressibility or durometer of the pressure-absorbing member can be such that it is capable of attenuating pressure fluctuations in the liquid during normal pumping operation, in addition to accommodating freeze-expansion of the liquid in the pump cavity. In alternative embodiments, if the pressure-absorbing member 124 is intended only to attenuate pressure fluctuations, it can be smaller than a corresponding member intended to protect against freeze-expansion, depending upon the amplitude of the target pressure fluctuations. An additional advantage of the pressure-absorbing member is that by occupying space in the pump cavity, it can reduce the amount of liquid in the pump cavity and, therefore, the total volumetric expansion of that liquid upon freezing.

Figure 11A:
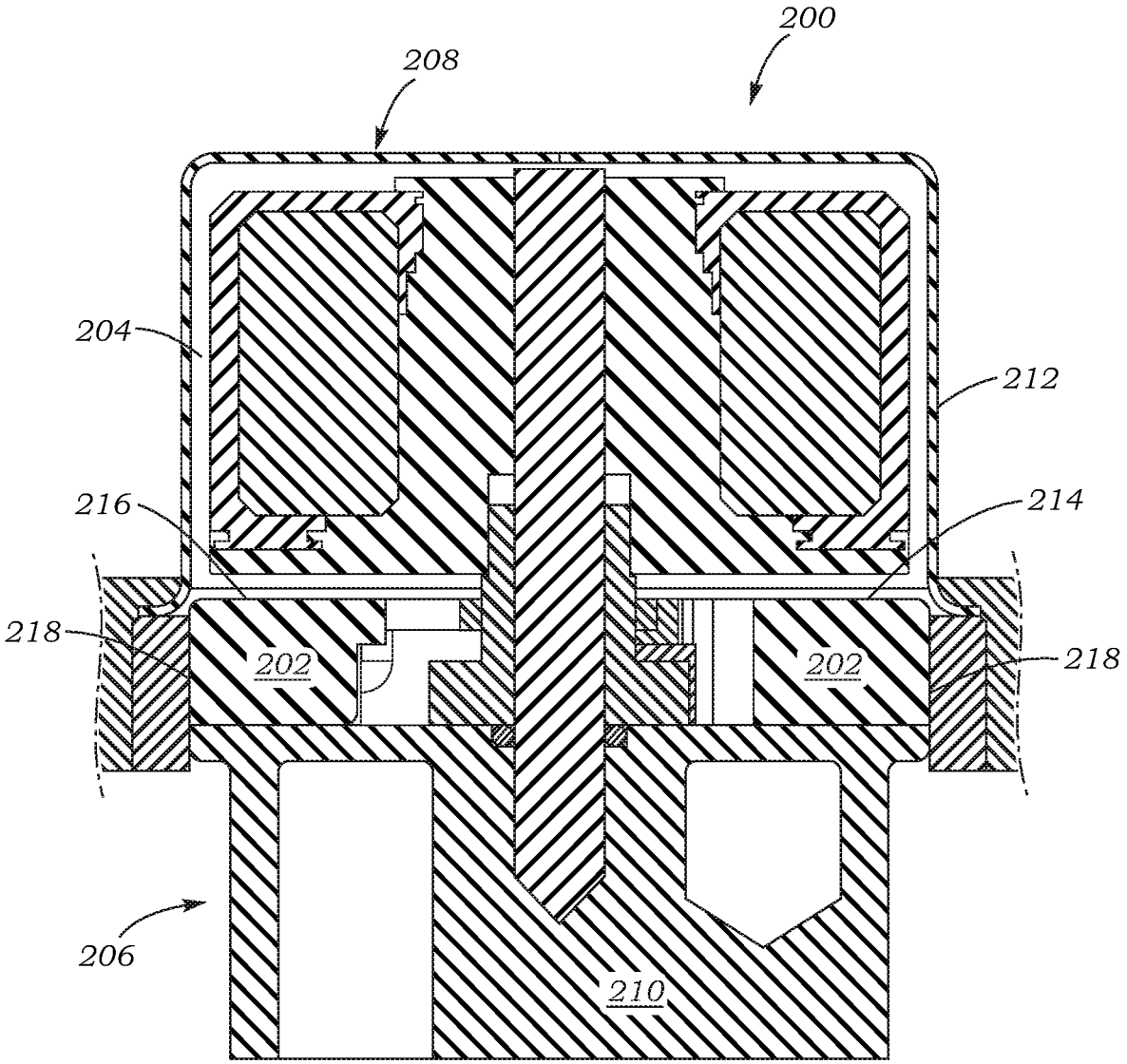
FIG. 11A is a sectional elevation view of another embodiment of a pump including a pressure-absorbing member secured with a retaining member.

FIG. 11A illustrates a cross-sectional detail view of another embodiment of a pump 200 including a pressure-absorbing member 202 situated in a pump cavity 204 of the pump. The pump 200 can include a pump-head portion 206 and a pump-driver portion 208 similar to the embodiment of FIG. 1 described above. The pressure-absorbing member 202 can be disposed between a pump body 210 and a magnet cup 212 in the pump cavity 204. A retaining member 214 can be situated coaxially around the pressure-absorbing member 202. The retaining member 214 can have side portions 218 situated around the exterior of the pressure-absorbing member 202, and a top portion 216 extending over the pressure-absorbing member and positioned between the pressure-absorbing member and the magnet cup 212. In certain embodiments, the retaining member 214 can be unrestrained such that the retaining member can move or "float" within the space between the pump body 210 and the magnet cup 212, as desired. In this manner, the retaining member 214 can move with the pressure-absorbing member 202 as the pressure-absorbing member deforms in response to pressure exerted by frozen liquid in the pump cavity 204. When the liquid thaws, the pressure-absorbing member 202 can expand to its original size, and can thereby exert force on the retaining member 214 to return the retaining member to its original location within the pump cavity 204. In alternative embodiments, the retaining member 214 can also be secured to the pump-head portion 206, as desired.

Figure 11B:
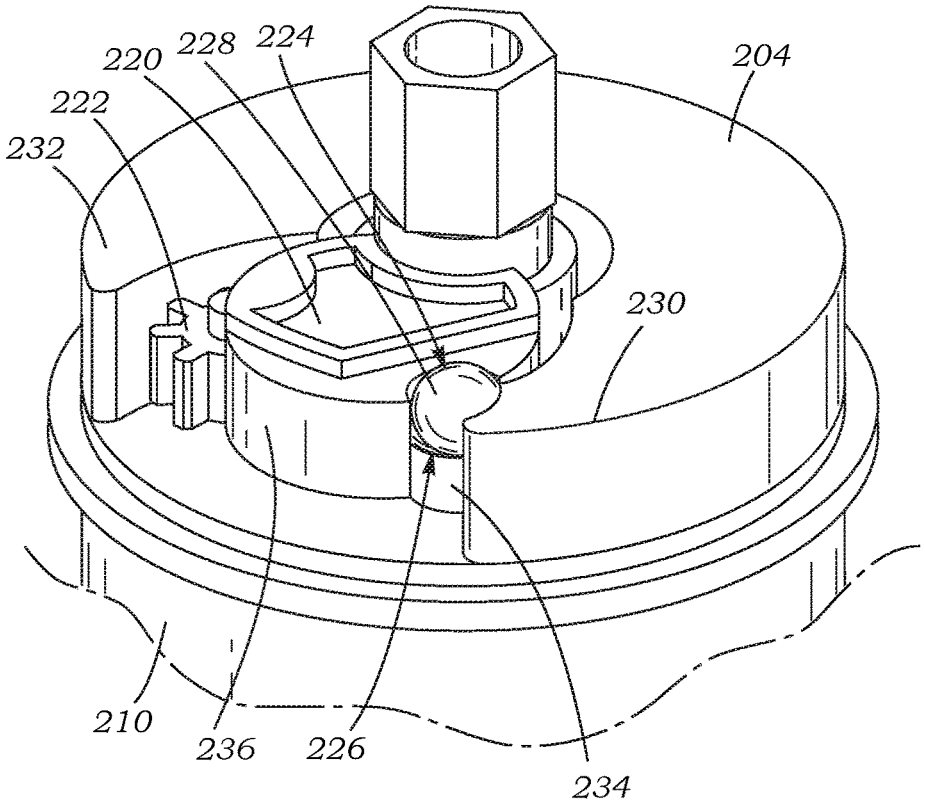
FIG. 11B is a perspective view of the pump body of the pump of FIG. 11B illustrating the pressure-absorbing member including a round member engaged with the suction shoe.

FIG. 11B illustrates a perspective view of the pump body 210 with the magnet cup 212 removed for purposes of illustration. Referring to FIG. 11B, the pressure-absorbing member 204 can be crescent-shaped, and can include first and second end portions 230, 232. The pressure-absorbing member 204 can extend around a suction shoe 220 of the pump 200 such that the suction shoe is received between the first and second end portions 230, 232 of the pressure-absorbing member. The suction shoe 220 can at least partially surround the pump gears of the pump (only driven gear 222 is visible in FIG. 11B). The suction shoe 220 can include an engaging portion configured as a recessed portion 224 including a rounded pocket or cup-shaped portion 226. The cup-shaped portion 226 is defined in a cylindrically-shaped portion 234 extending from an outer wall 236 of the suction shoe 220, and is located midway along a height of the suction shoe in the illustrated configuration.

Meanwhile, the pressure-absorbing member 204 can include an engaging portion extending from the pressure-absorbing member and configured as a ball-shaped member or spherically-shaped member 228. In the illustrated embodiment, the ball-shaped member 228 extends from the first end portion 230, and can be received in the cup-shaped portion 226 of the suction shoe 220. In this manner, the pressure-absorbing member 204 can engage the suction shoe 220. In certain embodiments, the ball-shaped member 228 can be configured to allow the suction shoe 220 to move relative to the pump body 210 and/or relative to the pressure-absorbing member 204 within a predetermined range of motion. For example, in embodiments in which the pressure-absorbing material 204 is made of a flexible material, the ball-shaped member 228 and/or the end portion 230 of the pressure-absorbing member may be configured to elastically deform to allow motion of the suction shoe. In other embodiments, the cup-shaped portion 226 may be larger than the ball-shaped member 228 such that the suction shoe 220 can move relative to the pressure-absorbing member 204 within the boundaries established by the cup-shaped portion 226. In yet further embodiments, the pressure-absorbing member 204 and the suction shoe 220 can move or float together with respect to the surface of the pump body 210 during pump operation, or between successive stops and starts of the pump.

Figure 12B:
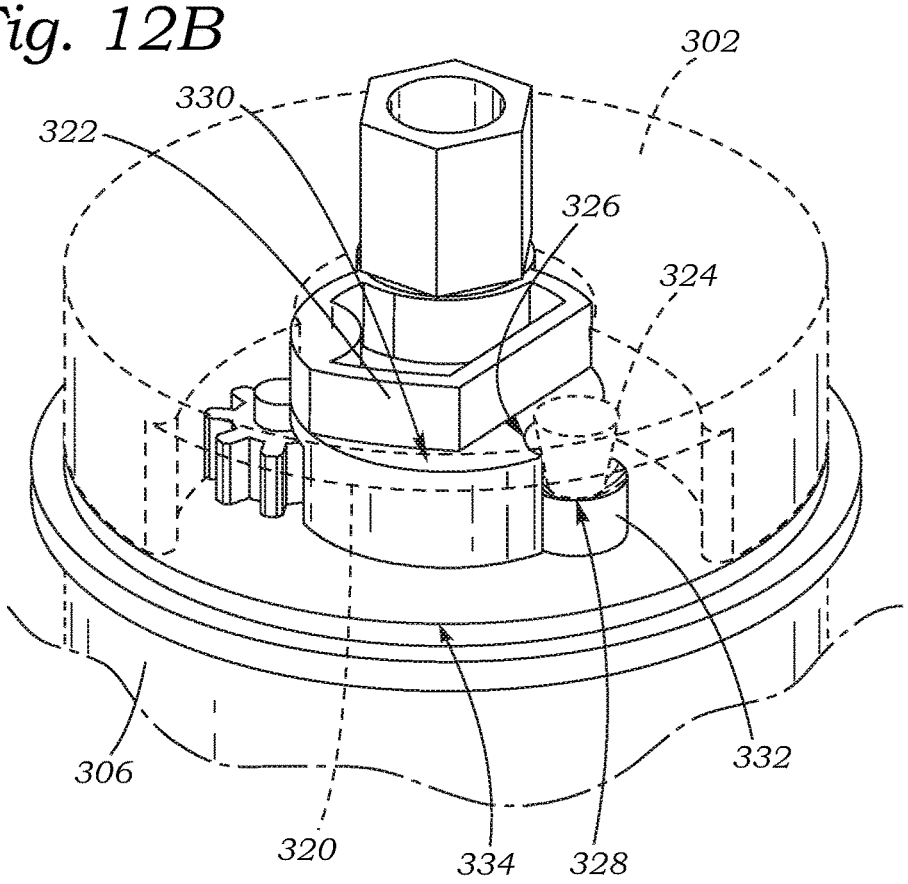
FIG. 12B is a perspective view of the pump body of FIG. 12B illustrating a cone-shaped projection of the pressure-absorbing member engaged with the suction shoe.
Figure 12A:
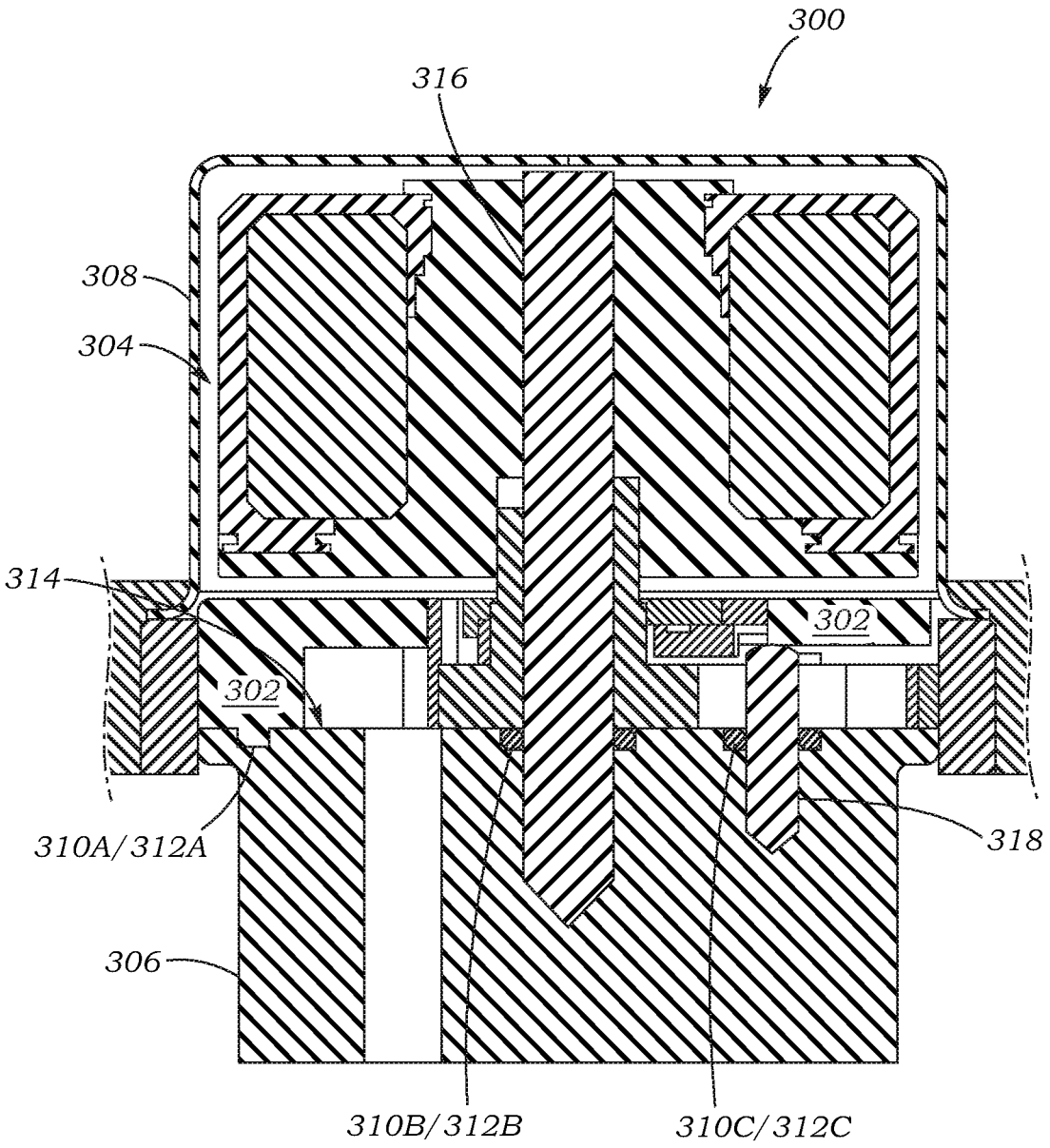
FIG. 12A is a sectional elevation view of another embodiment of a pump including a pressure-absorbing member having a plurality of extension portions configured to be received in corresponding recesses in the pump body.

FIG. 12A illustrates a cross-sectional detail view of another embodiment of a pump 300 including a pressure-absorbing member 302 situated in a pump cavity 304 of the pump. The pressure-absorbing member can be situated between a pump body 306 of the pump and a magnet cup 308. The pressure-absorbing member 302 can include one or more extension portions 310 configured to be received in corresponding recesses 312 defined in a surface 314 of the pump body 306. For example, in the illustrated embodiment, the pressure-absorbing member 302 includes three extension portions 310, with a first extension portion 310A being located near a radially outward edge of the surface 314 and received in a recess 312A, a second extension portion 310B located adjacent or surrounding a central shaft 316 and received in a recess 312B, and a third extension portion 310C located adjacent a passage 318 (configured to receive e.g., a shaft) and received in a recess 312C. However, it should be understood that the pressure-absorbing member can include any suitable number of extension portions located at any suitable location. Furthermore, it should be understood that extension portions similar to the extension portions 310 can be used in combination with any of the pressure-absorbing members described herein.

FIG. 12B is a perspective view of the pump body 306 of FIG. 12A with the magnet cup 308 removed and the pressure-absorbing member 302 shown in phantom lines for purposes of illustration. The pressure-absorbing member 302 can include an extension portion 320 extending over a suction shoe 322. The pressure-absorbing member 302 can include an engaging portion configured as a cone-shaped protrusion or member 324. The suction shoe 322 can include an engaging portion configured as a recess 326. The recess 326 can include a cup-shaped portion 328, which can be configured to receive the cone-shaped member 324. In the illustrated embodiment, the recess 326 is defined in an upper surface 330 of the suction shoe 322, and the cup-shaped portion is defined in a cylindrically-shaped portion 332 extending from an outer wall 334 of the suction shoe and midway along a height of the suction shoe. In this manner, the cone-shaped member 324 of the pressure-absorbing member 302 can engage the cup-shaped portion 328 of the suction shoe 322, and can hold the suction shoe 322 in place on the pump body 306. The cup-shaped portion 328 and the cone-shaped member 324 may also be sized such that the cup-shaped portion establishes a predetermined range of motion within which the suction shoe 322 may move relative to the pump body 306. The round shape of the cup-shaped portion 328 can also allow the cone-shaped member 324 to urge the suction shoe radially inwardly from an outer edge portion 334 of the pump body 306 toward the shaft 316 (FIG. 12A), and/or to center the suction shoe about the pump gears.

Although the pump configurations shown herein are suction-shoe style pumps, it should be understood that the pressure-absorbing member configurations described herein can also be used in combination with cavity-style pumps, in which the pump gears run in a cavity (e.g., defined in the pump body) and a suction shoe is not required. For example, in alternative embodiments, the pump 100 can be configured as a cavity style pump, in which the pump gears 110, 114 are situated in a cavity plate sealed between the pump body 136 and a bearing plate. The pressure-absorbing member embodiments described herein can also be used in pumps including other types of rotary pumping elements, such as inter-digitating lobes which, when contra-rotated relative to each other, produce liquid flow. The pressure-absorbing member embodiments described herein can also be used in combination with other types of pumps, such as piston pumps.

In alternative embodiments, the pressure-absorbing members described herein can be inflatable balloons or bladders (containing, for example, a gas or a liquid with a freezing point lower than that of water) configured to be compressed in response to pressure in the pump beyond a selected threshold.

Figure 13:
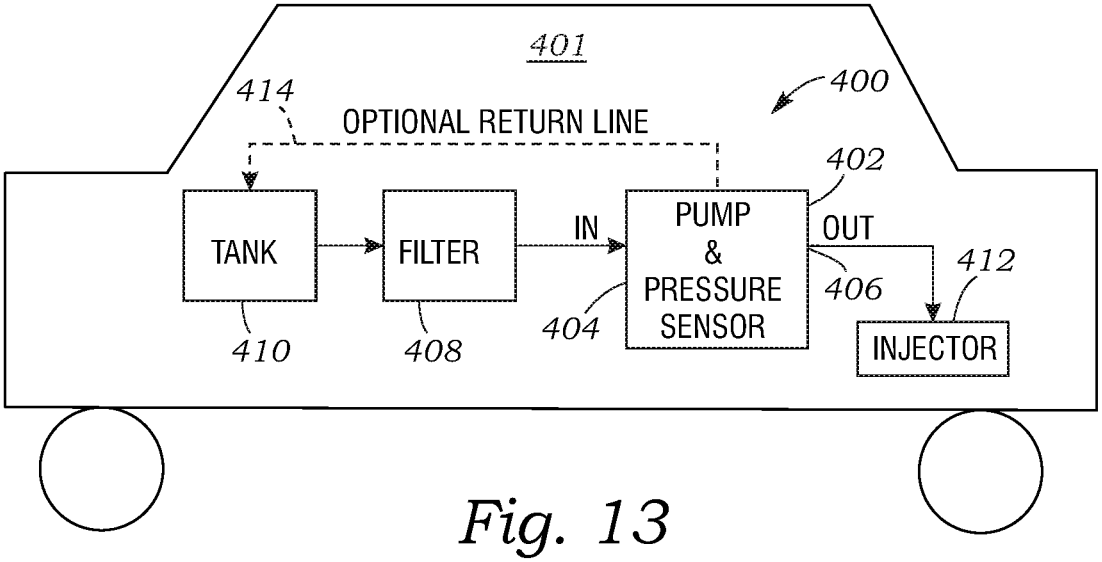
FIG. 13 is a schematic block diagram illustrating a representative embodiment of a fluid circuit located in a vehicle.

FIG. 13 illustrates a representative embodiment of a hydraulic circuit 400 including a pump 402, such as any of the specific pump embodiments described herein. The hydraulic circuit 400 represents a circuit as used in internal combustion engine applications, such as automotive applications, in which at least the pump 402 is located in an environment that experiences episodes of freezing. In the exemplary embodiment illustrated in FIG. 13, the hydraulic circuit 400 is shown schematically in a vehicle 401. As used herein, the term "vehicle" refers to any vehicle that has a power source (e.g., an engine), or any similar engine application. A vehicle or an engine application can include an automobile (such as a car, truck, tractor-trailer, a recreational vehicle, a motor home, a boat or a ship, or a military vehicle) a power generator, or other stationary engine application.

The pump 402 includes an inlet 404, an outlet 406, and can optionally include a pressure sensor such as pressure transducer 109 described above. The inlet 404 is situated downstream of a filter 408, which is situated downstream of a reservoir or tank 410 for liquid to be pumped by the pump. The outlet 406 is in fluid communication with a downstream injector 412 or other component from which pumped liquid is discharged from the circuit 400. In certain configurations, the circuit 400 can include an optional return line 414 for returning liquid to the tank 410 that is not actually discharged from the injector 412. Since the pump 402 includes the pressure-absorbing feature(s) as described above, freeze-expansion of the liquid inside the pump 402 is accommodated, and pump damage can be prevented.

In certain embodiments, the hydraulic circuit 400 can be a selective catalytic reduction (SCR) system to reduce the nitrogen oxides ($NO_x$) emitted by an internal combustion engine of the vehicle 401 in which the hydraulic circuit 400 is incorporated. For example, in an SCR system, the liquid in the tank 410 can be an aqueous solution containing a reagent such as aqueous ammonia ($NH_3$(aq)) or a urea solution ($CO(NH_2)_2$). In certain embodiments, the engine can be a compression-ignition engine, such as a diesel engine, or a spark-ignition engine, such as a gasoline engine. Injection of the aqueous reagent solution into the exhaust of the engine by the injector 412 can reduce the amount of nitrogen oxide compounds emitted by the engine.

General Considerations

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Features, integers, characteristics, compounds, chemical moieties or groups described in conjunction with a particular aspect, embodiment or example of the disclosed technology are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The scope of the disclosure is not restricted to the details of any foregoing embodiments. The scope of the disclosure extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods. As used herein, the terms "a", "an", and "at least one" encompass one or more of the specified element. That is, if two of a particular element are present, one of these elements is also present and thus "an" element is present. The terms "a plurality of" and "plural" mean two or more of the specified element.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

In some examples, values, procedures, or apparatus' are referred to as "lowest," "best," "minimum," or the like. It will be appreciated that such descriptions are intended to indicate that a selection among many used functional alternatives can be made, and such selections need not be better, smaller, or otherwise preferable to other selections.

As used herein, the term "and/or" used between the last two of a list of elements means any one or more of the listed elements. For example, the phrase "A, B, and/or C" means "A", "B,", "C", "A and B", "A and C", "B and C", or "A, B, and C."

As used herein, the term "coupled" generally means physically coupled or linked and does not exclude the presence of intermediate elements between the coupled items absent specific contrary language.

As used herein, a "pump-head" is an assembly including a pump body, a pump element disposed in or on the pump body, at least one inlet, and at least one outlet.

As used herein, a "pump" is a pump-head including the pump-driver portion or mover.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims.

What is claimed is:

1. A pump, comprising:

a pump-head portion including a pump body and a magnet cup, the pump body having a longitudinal axis and defining at least one inlet and at least one outlet, the pump body and the magnet cup together defining a pump cavity that is in contact with a liquid being pumped whenever the pump cavity is primed with the liquid;

a suction shoe situated on a surface of the pump body, the suction shoe including an engaging portion comprising a concave or convex axially-aligned end surface facing in the axial direction of the pump body;

a movable pumping member situated in the pump cavity and at least partially received within the suction shoe, the pumping member, when driven to move, urging flow of the liquid from the inlet through the pump cavity and the magnet cup to the outlet;

a permanent magnet situated in the magnet cup, the magnet being rotatable in the magnet cup and being coupled to the movable pumping member in the pump cavity;

a pump-driver portion including a magnet driver located outside the magnet cup, the magnet driver being magnetically coupled through the magnet cup to the magnet to rotate the magnet in the magnet cup and, thus, move the pumping member in the pump cavity; and a pressure-absorbing member situated in the pump cavity, the pressure-absorbing member being configured to engage the concave or convex axially-aligned end surface of the engaging portion of the suction shoe such that the suction shoe is urged radially inwardly with respect to an outer edge portion of the surface of the pump body.

2. The pump of claim 1, wherein:

the concave or convex axially-aligned end surface is a convex axially-aligned end surface;

the engaging portion of the suction shoe comprises an extension portion including the convex axially-aligned end surface;

the pressure-absorbing member comprises a recess; and the extension portion of the suction shoe is received in the recess of the pressure-absorbing member.

3. The pump of claim 2, wherein the recess of the pressure-absorbing member comprises an angled surface configured to engage the extension portion such that the angled surface urges the suction shoe radially inwardly with respect to the outer edge portion of the surface of the pump body.

4. The pump of claim 2, wherein the recess of the pressure-absorbing member is configured such that the suction shoe can move relative to the pressure-absorbing member within a predetermined range of motion at least between stops and starts of the pump.

5. The pump of claim 1, wherein:

the concave or convex axially-aligned end surface of the engaging portion is a concave axially-aligned end surface;

the pressure-absorbing member comprises an extension portion;

the engaging portion of the suction shoe comprises a recess defining the concave axially-aligned end surface; and the extension portion of the pressure-absorbing member is received in the recess of the suction shoe.

6. The pump of claim 5, wherein:

the extension portion of the pressure-absorbing member is rounded such that the extension portion of the pressure-absorbing member urges the suction shoe radially inwardly with respect to the outer edge portion of the surface of the pump body.

7. The pump of claim 1, wherein:

at least a portion of the pressure-absorbing member extends along the longitudinal axis of the pump body between the surface of the pump body and an interior surface of the magnet cup when the pressure-absorbing member is in a non-deflected state; and the interior surface of the magnet cup is configured to contact an upper surface of the pressure-absorbing member such that the pressure-absorbing member is captured between the surface of the pump body and the interior surface of the magnet cup to limit axial movement of the pressure-absorbing member in the pump cavity.

8. The pump of claim 7, wherein:

the magnet cup includes a first portion and a second portion;

the second portion has a diameter that is greater than a diameter of the first portion such that the second portion defines an annular shoulder between the first and second portions; and the annular shoulder defines the interior surface of the magnet cup that limits axial movement of the pressure-absorbing member.

9. The pump of claim 8, wherein the permanent magnet is situated in the first portion of the magnet cup, and the pressure-absorbing member is situated in the second portion of the magnet cup.

10. The pump of claim 1, wherein:

the pressure-absorbing member defines a recess;

the pumping member comprises a pair of pump gears; and and the pump gears and the suction shoe are situated in the recess of the pressure-absorbing member.

11. The pump of claim 10, wherein the pressure-absorbing member further includes an extension portion that at least partially encloses the recess.

12. The pump of claim 1, wherein the pressure-absorbing member includes at least one extension portion configured to be received in a corresponding recess defined in the surface of the pump body.

13. A hydraulic circuit comprising:

the pump of claim 1;

a source of aqueous liquid upstream of and in fluid communication with the pump; and an injector downstream of and in fluid communication with the pump.

14. A vehicle including the pump of claim 1.

15. A gear pump-head, comprising:

a pump body and a magnet cup together defining a pump cavity, at least one inlet in fluid communication with the pump cavity, and at least one outlet in fluid communication with the pump cavity, the pump body having a longitudinal axis;

at least one driving gear and a driven gear enmeshed with each other in the pump cavity;

a suction shoe disposed on a surface of the pump body and situated about the driving gear and the driven gear, the suction shoe including an engaging portion comprising a concave or convex axially-aligned end surface facing in the axial direction of the pump body;

a permanent magnet situated in the magnet cup and being coupled to the driving gear; and a pressure-absorbing member situated in the pump cavity, the pressure-absorbing member being configured to engage the concave or convex axially-aligned end surface of the engaging portion of the suction shoe such that the suction shoe is urged radially inwardly with respect to an outer edge portion of the surface of the pump body.

16. The gear pump-head of claim 15, wherein:

the concave or convex axially-aligned end surface of the engaging portion is a convex axially-aligned end surface;

the engaging portion of the suction shoe comprises an extension portion including the convex axially-aligned end surface;

the pressure-absorbing member comprises a recess; and the extension portion of the suction shoe is received in the recess of the pressure-absorbing member.

17. The gear pump-head of claim 16, wherein the recess of the pressure-absorbing member comprises an angled surface configured to engage the extension portion such that the angled surface urges the suction shoe radially inwardly with respect to the outer edge portion of the surface of the pump body on which the suction shoe is situated.

18. The gear pump-head of claim 15, wherein:

the concave or convex axially-aligned end surface of the engaging portion is a concave axially-aligned end surface;

the pressure-absorbing member comprises an extension portion;

the engaging portion of the suction shoe comprises a recess defining the concave axially-aligned end surface; and the extension portion of the pressure-absorbing member is received in the recess of the suction shoe.

19. The gear pump-head of claim 18, wherein the extension portion of the pressure-absorbing member is rounded such that the extension portion of the pressure-absorbing member urges the suction shoe radially inwardly with respect to the outer edge portion of the surface of the pump body.

20. A gear pump-head, comprising:

a pump body and a magnet cup together defining a pump cavity, at least one inlet in fluid communication with the pump cavity, and at least one outlet in fluid communication with the pump cavity;

at least one driving gear and a driven gear enmeshed with each other in the pump cavity;

a suction shoe disposed on a surface of the pump body and situated about the driving gear and the driven gear, the suction shoe including an engaging portion comprising a concave or convex axially-oriented end surface;

a permanent magnet situated in the magnet cup and being coupled to the driving gear; and a pressure-absorbing member situated in the pump cavity, at least a portion of the pressure-absorbing member extending along a longitudinal axis of the pump between a surface of the pump body and an interior surface of the magnet cup when the pressure-absorbing member is in a non-deflected state, the interior surface of the magnet cup being configured to contact an upper surface of the pressure-absorbing member such that the pressure-absorbing member is captured between the surface of the pump body and the interior surface of the magnet cup to limit axial movement of the pressure-absorbing member in the pump cavity, the pressure-absorbing member being configured to engage the concave or convex axially-oriented end surface of the engaging portion of the suction shoe such that the suction shoe is urged radially inwardly with respect to an outer edge portion of the surface of the pump body.

* * * * *